United States Patent [19]

Weaver

[11] Patent Number: 4,882,017

[45] Date of Patent: Nov. 21, 1989

[54] METHOD AND APPARATUS FOR MAKING LIGHT METAL-ALKALI METAL MASTER ALLOY USING ALKALI METAL-CONTAINING SCRAP

[75] Inventor: Mark L. Weaver, Allison Park, Pa.

[73] Assignee: Aluminum Company of America, Pittsburgh, Pa.

[21] Appl. No.: 208,466

[22] Filed: Jun. 20, 1988

[51] Int. Cl.[4] ..... C25C 3/36; C25C 3/24; C25C 7/00; C25C 7/04

[52] U.S. Cl. ..... 204/71; 204/140; 204/244; 204/245; 204/246; 204/273; 204/295; 204/251

[58] Field of Search ..... 204/68, 71, 140, 243 R-247, 204/250-251, 252, 295, 67, 273

[56] References Cited

U.S. PATENT DOCUMENTS

| | | | |
|---|---|---|---|
| 2,697,597 | 12/1954 | Weiss | 266/15 |
| 2,715,063 | 8/1955 | Weiss | 75/68 |
| 2,787,592 | 4/1957 | Burkhardt | 204/140 |
| 3,109,785 | 11/1963 | Gordon | 204/90 |
| 3,335,076 | 8/1967 | Burkhardt | 204/245 X |
| 3,488,271 | 1/1970 | Kummer et al. | 204/180 |
| 3,502,553 | 3/1970 | Gruber | 204/244 X |
| 3,607,684 | 9/1971 | Kuhn | 204/62 |
| 4,115,215 | 9/1978 | Das et al. | 204/67 |
| 4,156,635 | 5/1979 | Cooper et al. | 204/68 |
| 4,183,745 | 1/1980 | Tsumura | 75/68 R |
| 4,338,177 | 7/1982 | Withers et al. | 204/245 X |
| 4,430,174 | 2/1984 | Tsumura | 204/67 |
| 4,455,202 | 6/1984 | Sintim-Damoa et al. | 204/68 |
| 4,521,284 | 6/1985 | Tanabe et al. | 204/71 |
| 4,533,442 | 8/1985 | Neelameggham et al. | 204/68 |
| 4,790,917 | 12/1988 | Dewing | 204/140 |

FOREIGN PATENT DOCUMENTS

| | | | |
|---|---|---|---|
| 3532956 | 3/1987 | Fed. Rep. of Germany . | |
| 1445683 | 6/1965 | France | 204/71 |
| 50-8682 | 4/1975 | Japan | 204/71 |
| 50-36412 | 11/1975 | Japan | 204/71 |
| 666281 | 2/1952 | United Kingdom | 204/71 |

OTHER PUBLICATIONS

U.S. Application Ser. No. 064,709, filed Jun. 22, 1987, now U.S. Pat. No. 4,780,186, to Roy A Christini et al., on "Lithium Transport Cell Process".

U.S. application Ser. No. 098,984, filed Sep. 21, 1987 to Kenneth A. Bowman, on "Electrolytic Process for Recovering Lithium from Aluminum—Lithium Alloy Scrap".

*Primary Examiner*—Donald R. Valentine

*Attorney, Agent, or Firm*—Gary P. Topolosky

[57] ABSTRACT

A method for making light metal-alkali metal master alloy using alkali metal containing scrap comprises: (a) establishing an electrolytic cell divided into two or more laterally adjacent areas by porous alkali metal ion transport means, said cell including a first cell area supplied with alkali metal-containing scrap and a second cell area consisting essentially of molten light metal; (b) supplying current to this cell for transporting alkali metal ions from the first cell area to the second cell area; (c) forming master alloy by combining these ions with the molten light metal in said second cell area; and (d) withdrawing master alloy from the second cell area. An apparatus for making aluminum-lithium or magnesium-lithium master alloy using the lithium from aluminum-lithium alloy scrap is also disclosed.

43 Claims, 1 Drawing Sheet

METHOD AND APPARATUS FOR MAKING LIGHT METAL-ALKALI METAL MASTER ALLOY USING ALKALI METAL-CONTAINING SCRAP

BACKGROUND OF THE INVENTION

This invention relates to a method and apparatus for using the alkali metal recovered from alkali metal-containing scrap. The invention further relates to making master alloy using the lithium recovered from aluminum-lithium alloy scrap.

Fuel costs continue to be economically significant in today's aerospace industry. Aircraft designers and manufacturers are constantly striving to improve overall efficiency and performance. Such improvements may be accomplished by reducing the effective weight of materials used to manufacture component parts while maintaining the strength, toughness, corrosion resistance and/or other properties desired for such component parts. In recent years, aluminum-lithium alloys have been receiving more attention as candidates for structural metal applications in the aerospace industry. It is well recognized that additions of lithium to aluminum often results in reduced alloy density and, thus, lower effective weight. Since many manufacturing, thermal treatment and machining techniques relating to aluminum-lithium alloys are still in their experimental or developmental stages, large quantities of aluminum-lithium alloy scrap are being generated for every pound of usable metal produced. For cost, processing and disposal concerns, it would be desirable to recycle most of the lithium within such scrap for subsequent metal alloy production. Although lithium-containing scrap is usually separated from other metal scrap for handling and/or remelting purposes, aluminum-lithium alloy scrap may still contain variable quantities of still undesirable elements, such as zinc, manganese, titanium and iron. The presence of these latter elements makes it difficult to merely recast alloy scrap directly into marketable ingots.

Because of increasing costs associated with mining lithium ores and refining substantially pure lithium therefrom, alternative methods continue to be sought for recovering lithium from lithium-containing scrap. Standard recovery techniques for other metals, including magnesium, are not always applicable to aluminum-lithium alloy scrap. Molten lithium is highly susceptible to oxidation and hydrogen contamination while causing most refractory materials in contact with it to rapidly deteriorate or otherwise corrode away.

BRIEF DESCRIPTION OF THE INVENTION

It is a principal object of this invention to provide efficient means for removing lithium from aluminum-lithium alloy scrap and making a lithium-containing master alloy therefrom.

It is a further object to provide means for making light metal-alkali metal master alloy using a molten light metal cathode and the lithium recovered from molten aluminum-lithium alloy scrap.

It is still a further object to produce aluminum-lithium or magnesium-lithium master alloy in an electrolytic cell divided into substantially vertically-oriented areas by one or more porous membranes capable of conducting lithium ions therethrough and further capable of withstanding prolonged contact with molten aluminum-lithium. It is a further object to provide this cell with means for preventing master alloy exposure to harmful reactants including air.

It is still a further object to recover lithium from alloy scrap at relatively low temperatures, thereby lowering the activity and losses due to vaporization of the lithium recovered.

In accordance with the foregoing objects and advantages, there is disclosed a method for making light metal-alkali metal master alloy using alkali metal-containing scrap which commences by establishing an electrolytic cell divided into two or more laterally adjacent areas by means for transporting alkali metal ions from the first cell area supplied with alkali metal-containing scrap to a second cell area consisting essentially of molten light metal. This method then proceeds by supplying current to said cell at a sufficient rate for transporting substantially only alkali metal ions from the first cell area to the second cell area; forming master alloy by combining molten light metal with the alkali metal ions in the second cell area; and withdrawing master alloy from this second cell area. On a more preferred basis, alkali metal ions are substantially distributed throughout the second cell area by stirring or other known means, while the ion transporting means of said cell consists of at least one porous membrane in substantial contact with an alkali metal ion-conducting electrolyte. Said electrolyte may include one or more of lithium chloride, lithium fluoride, calcium fluoride and potassium chloride. When the cell contains two or more porous membranes for defining a third area between the first and second cell areas, a sufficient amount of alkali metal ion-conducting electrolyte is maintained between said membrane pairs.

Methods for making aluminum-lithium master alloy or magnesium-lithium master alloy are also disclosed herein. There is still further described an electrolytic cell for making light metal-alkali metal master alloy using the alkali metal from alkali metal-containing scrap. This electrolytic cell comprises a containment having a plurality of walls defining two or more substantially vertically-oriented areas, a first cell area adapted to contact with a molten anode which includes alkali metal-containing scrap and a second cell area adapted to contact with a cathode consisting essentially of molten light metal. This cell further comprises means for transporting substantially only alkali metal ions from the first cell area to the second cell area; and means for supplying current to the cell. On a more preferred basis, the foregoing cell further includes one or more of: means for removing master alloy from the second cell area; means for preventing exposure of master alloy to gaseous reactants including air; and means for distributing alkali metal substantially throughout the second cell area.

BRIEF DESCRIPTION OF THE DRAWINGS

Further features, other objects and advantages of this invention will become clearer from the following detailed description of preferred embodiments made with reference to the drawings in which.

DETAILED DESCRIPTION OF THE PREFERRED EMBODIMENTS

Figure 1:
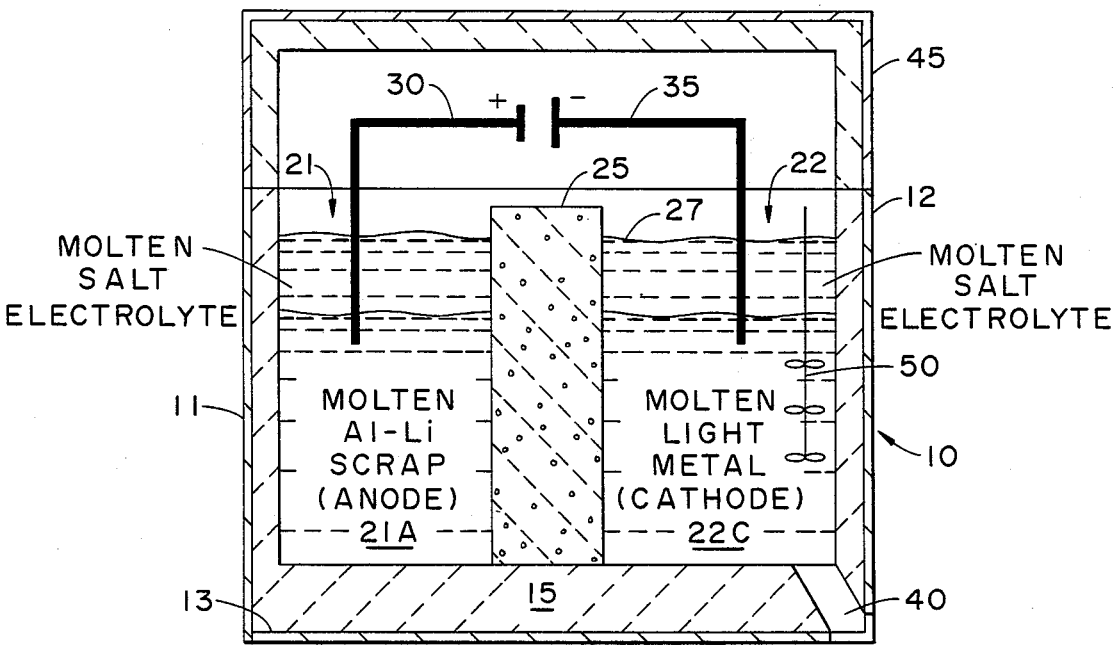
FIG. 1 is a schematic view of one embodiment of an electrolytic cell according to the present invention.

Referring now to FIG. 1, there is schematically illustrated one embodiment of an electrolytic cell for making light metal-alkali metal master alloy using the alkali metal from alkali metal-containing scrap. This cell includes a containment, generally 10, consisting of a plurality of walls 11 and 12 with floor 13 positioned therebeneath. In the embodiment shown, containment 10 is a high strength, corrosion resistant, nickel-based alloy. The walls and floor to containment 10 are preferably lined with a material capable of resisting prolonged contact with molten lithium or lithium-containing alloys. In preferred embodiments, material liner 15 consists essentially of magnesium oxide, aluminum oxide, magnesium aluminate or mixtures thereof. When alkali metal ion-transporting means are positioned between walls 11 and 12, this electrolytic cell becomes divided into at least two substantially vertically oriented cell areas. A first cell area 21 is adapted to contact with a molten anode made from an alkali metal-containing scrap 21A, most preferably aluminum-lithium alloy scrap. In alternative embodiments, solid Al-Li alloy scrap may be introduced to the first cell area before being heated to one or more temperatures above about 625° C. (1157° F.). The second cell area 22 contacts with a cathode 22C consisting essentially of molten light metal such as aluminum, magnesium or mixtures thereof.

Within this cell, one means for transporting alkali metal ions from first cell area 21 to second cell area 22 includes a substantially porous membrane 25 which is also capable of withstanding prolonged contact with molten aluminum-lithium alloys. Porous membrane 25 should also be in substantial contact with a molten salt electrolyte 27 which assists in conducting substantially only alkali metal (lithium) ions from first cell area 21 to second cell area 22. By substantial contact, it is meant that porous membrane 25 should be sufficiently saturated with electrolyte 27, impregnated with solid and/or liquid deposits of the same or substantially immersed under a layer of said electrolyte. In accompanying FIG. 1, molten salt electrolyte 27 extends over anode 21A and cathode 22C on both the left and right sides of porous membrane 25.

The schematic cell at FIG. 1 further includes means for supplying current to the electrodes of this cell and effecting transport of lithium ions from first cell area 21 to second cell area 22. More particularly, anode lead 30 extends directly into molten anode 21A while cathode lead 35 extends at least partially into its corresponding molten light metal cathode 22C. Electrode leads 30 and 35 may be made from carbonaceous product, silicon carbide or other suitable materials. On a preferred basis, this electrolytic cell further includes one or more other component parts. For example, the cell of this invention may include means for removing master alloy from the second cell area. In FIG. 1, master alloy removal means consists of at least one channel 40 extending through the material liner 15 and cell floor 13 adjacent sidewall 12. It is to be understood that one or more channels may be extended through other parts of the same cell for alloy removal purposes. Containment 10 may also include means for preventing exposure of the master alloy within second cell area 22 to potentially harmful reactants, especially gaseous reactants including air. The exposure prevention means in FIG. 1 consists of a substantially airtight seal or cover 45 extending directly over the cell. As shown, cover 45 is lined with the same lithium-resisting material as containment 10. Cover 45 may be further adapted to accommodate extensions of current supply means 30 and 35 therethrough. In situations where cover 45 is not completely airtight, the area of the cell over anode 21A and cathode 22C may be continuously flushed with a non-reactive gas such as argon. In order to promote a more even distribution of alkali metal ions throughout the light metal cathode during electrolysis, the cell of FIG. 1 further includes at least one stirring means 50 extending into second cell area 22. When alkali metal (lithium) ions distribute more evenly, concentrated polarization zones are less likely to develop, thereby improving cell efficiency by lowering operation voltage and minimizing heat accumulation.

Figure 2:
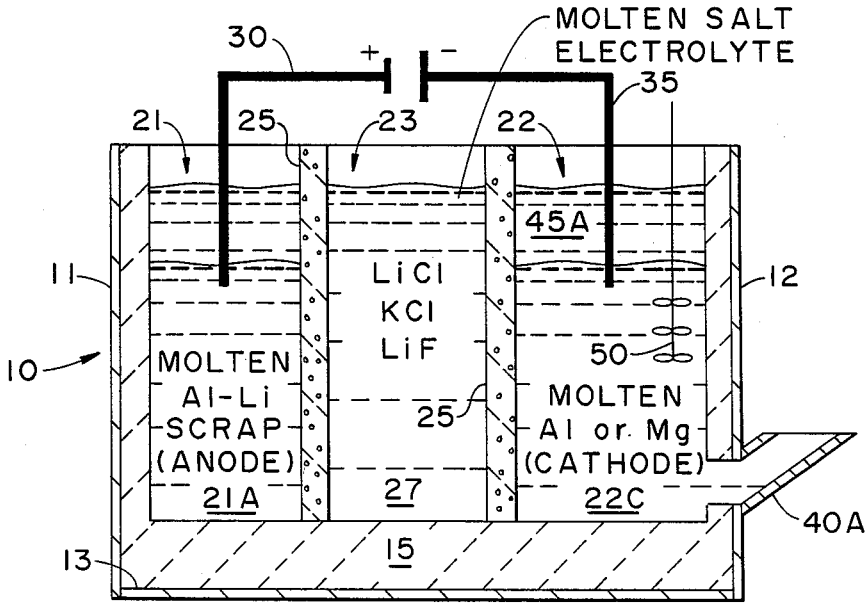
FIG. 2 is a schematic view of another cell embodiment for practicing the method of this invention.

In the alternative embodiment of FIG. 2, equivalent elements to the cell at FIG. 1 are correspondingly numbered. As such, containment 10 of FIG. 2 likewise consists of sidewalls 11 and 12, floor 13 and a material liner 15. Between sidewalls 11 and 12, there are positioned at least two porous membranes 25 for dividing the cell into a first cell area 21 in contact with molten alloy scrap 21A; a second cell area 22 which initially contacts substantially pure molten light metal cathode 22C before it is converted to master alloy; and a third cell area 23 intermediate the first and second cell areas. Third cell area 23 contacts with a sufficient amount of molten salt, alkali metal ion-conducting electrolyte 27. Said electrolyte must not contain any cations which reduce more easily than lithium. As such, electrolyte 27 should not contain any aluminum chloride, magnesium chloride, sodium chloride or calcium chloride. On a preferred basis, electrolyte 27 includes one or more of lithium chloride, lithium fluoride and potassium chloride. Some calcium fluoride may also be added to this electrolytic bath composition.

The porous membranes 25 which divide the cell of FIG. 2 into three separate compartments must be able to conduct alkali metal ions therethrough. It is preferred that said membranes conduct substantially only alkali metal (lithium) ions therethrough during the operation of this cell. Suitable materials for such membranes include magnesium oxides having a porosity between about 15–40%, or more preferably between about 20–35%.

The cell of FIG. 2 further contains a pair of current supply means; namely, anode lead 30 extends into molten anode 21A and cathode lead 35 extends into molten cathode 22C. In this embodiment of the invention, master alloy removal means consists of tap hole 40A. Other known or subsequently developed means may also be substituted for tap hole 40A. Although the containment 10 of this cell does not include a substantially airtight cover, exposure of master alloy within second cell area 22 to harmful reactants is nevertheless prevented by maintaining a layer of non-reactive molten salt electrolyte 45A thereover. Other inert materials, such as liquid argon, may also be substituted therefor. A comparable electrolyte layer may also be extended over molten anode 21A as shown in FIG. 2.

With either cell arrangement above, current efficiencies at or above about 95% are achievable. These cells operate at between about 650°–850° C. (1202°–1562° F.), or much lower than the temperatures at which lithium vaporizes, thus further enhancing overall cell efficiency. Preferred anode densities within this cell should be kept below about 6 amps/square inch. At densities above said maximum, oxidation at the cell anode is more random such that some aluminum and magnesium may also be transported from first cell area 21 to second cell area 22.

It is believed that the foregoing methods and apparatus produce molten light metal-alkali master alloy according to the following mechanisms. Alkali metal ions are essentially transported through one or more porous membranes (and any ion-conducting electrolyte therebetween) via salt migration. The voltage used for this reaction is substantially lower than that needed to generate chlorine gas within the cell, or any respective membranes. The present invention proceeds by transporting only lithium ions between cell areas without any chlorine gas generation whatsoever.

The following examples are provided by way of further illustration. They are not intended to limit the scope of this invention in any manner.

EXAMPLE 1

A bench scale cell was constructed in accordance with above FIG. 1. The containment of this cylindrically-shaped cell was made from a nickel-based alloy sold as "Inconel 625" by the International Nickel Company, Inc. of Saddlebrook, N. J. This containment measured 12 inches deep×10¾ inches in diameter. It was lined with a castable magnesium oxide refractory sold by Allied Mineral Products, Inc. of Columbus, Ohio to form a reaction chamber measuring 5¾×4½×5 inches. The reaction chamber was divided into two cell areas by one ¼-inch thick membrane/plate made from high purity magnesium oxide having a density of 2.6 g/cc. Within the first cell area, measuring 3⅜×4½ inches, there was introduced 2,435 g. of scrap metal alloy analyzed to contain: 1.85 wt. % Li; 1.33 wt. % Cu; 1.05 wt. % Mg and the balance aluminum. On the opposite side of this membrane/plate, 464 grams of 99.9% pure magnesium was added to the second cell area measuring 2⅛×4½ inches. Both sides of the cell were then covered with 600 g of a molten salt electrolyte bath consisting of 70% LiCl, 25% KCl and 5% LiF. Leads of titanium diboride embedded in graphite were then lowered into the respective cell areas to serve as electrodes. The cell was heated to about 700° C. (1292° F.), periodically hand-stirred and supplied with a current density of 3.9 amp/in$^2$ anode. After 2½ hours, the molten scrap remaining in the first cell area and master alloy sample removed from the second cell area were analyzed as follows:

| Alloy Scrap | Master Alloy |
|---|---|
| Li 0.02 wt. % | Li 9.5 wt. % |
| Cu 1.37 wt. % | Al 0.2 wt. % |
| Mg 0.95 wt. % | Mg balance |
| Al balance | |

The current efficiency for this cell was determined to be about 89%.

EXAMPLE 2

A second membrane/plate was added to the cell of Example 1. The cell, which now resembled above FIG. 2, was thus divided into three laterally adjacent areas: a first and second cell area each measuring 2⅛×4½ inches separated by a third cell area measuring 1×4½ inches. All three cell areas were 5 inches deep. About 1,395 g of molten alloy scrap was added to the first cell area. This scrap was analyzed to contain 1.85 wt. % Li, 1.33 wt. % Cu, 1.05 wt. % Mg, the balance aluminum. 1,300 g of 99.99% pure aluminum was introduced to the second cell area while about 4,000 total grams of molten salt electrolyte was fed to the third cell area during filling and operation. The composition of said electrolyte was analyzed to include 70% LiCl, 25% KCl and 5% LiF. $TiB_2$-graphite leads were lowered into the respective compartments of this cell. The cell was then heated to about 665° C. (1229° F.), periodically hand-stirred, and supplied with a current density of 2.7 amp/in$^2$ anode for 90 minutes, after which time the remaining alloy scrap in the first cell area and master alloy in the second cell area were analyzed to include:

| Alloy Scrap | Master Alloy |
|---|---|
| Li 0.62 wt. % | Li 1.30 wt. % |
| Cu 1.26 wt. % | Mg 0.31 wt. % |
| Mg 0.86 wt. % | Al balance |
| Al balance | |

The current efficiency for this second cell was determined to be about 94.7%.

Having described the presently preferred embodiments, it is to be understood that the present invention may be otherwise embodied within the scope of the appended claims.

What is claimed is:

1. A method for making a light metal-alkali metal master alloy using alkali metal-containing scrap, said method comprising:

(a) establishing an electrolytic cell divided into two or more substantially laterally adjacent areas by means for transporting alkali metal ions from a first cell area supplied with alkali metal-containing scrap to a second cell area consisting essentially of molten light metal;

(b) supplying current to the cell at a sufficient rate for transporting alkali metal ions from the first cell area to the second cell area;

(c) forming master alloy by combining alkali metal ions with said molten light metal in the second cell area; and (d) withdrawing master alloy from the second cell area.

2. The method of claim 1 which further includes: distributing alkali metal ions substantially throughout the second cell area during recitation (c).

3. The method of claim 1 wherein the light metal of said master alloy is selected from aluminum, magnesium and mixtures thereof.

4. The method of claim 3 wherein the light metal of said master alloy is substantially pure aluminum.

5. The method of claim 1 wherein the alkali metal of said master alloy is lithium.

6. The method of claim 1 wherein the alkali metal-containing scrap supplied to the first cell area consists essentially of one or more lithium-containing aluminum alloys.

7. The method of claim 1 wherein the alkali metal ion transport means includes a substantially porous membrane.

8. The method of claim 7 wherein said porous membrane contacts substantially with an alkali metal ion-conducting electrolyte.

9. The method of claim 8 wherein said ion-conducting electrolyte includes one or more of: lithium chloride, lithium fluoride, calcium fluoride and potassium chloride.

10. The method of claim 1 wherein the transport means two or more substantially porous, electrically insulating membranes which define a third cell area intermediate the first and second cell areas; and an alkali metal ion-conducting electrolyte between said porous membranes.

11. The method of claim 1 which further includes:

covering at least the second cell area with means for preventing master alloy exposure to reactants including air.

12. The method of claim 11 wherein the alloy exposure prevention means includes:

a layer of molten salt electrolyte.

13. A method for making a light metal-lithium master alloy using a molten light metal cathode and the lithium recovered from aluminum-lithium alloy scrap, said method comprising:

(a) introducing aluminum-lithium alloy scrap to a first anode area of an electrolytic cell divided by one or more substantially vertically-oriented porous membranes in contact with a lithium-ion conducting electrolyte, a second cathode area of said cell adapted for contact with molten light metal;

(b) heating the aluminum-lithium alloy scrap to one or more elevated temperatures; and (c) supplying current to said cell for transporting lithium ions from the first anode area to the second cathode area and making master alloy thereby.

14. The method of claim 13 which further includes:

(d) stirring the molten light metal in said second cathode area.

15. The method of claim 14 which further includes:

(e) withdrawing master alloy from the second cathode area.

16. The method of claim 13 wherein the light metal of said master alloy is selected from aluminum, magnesium and mixtures thereof.

17. The method of claim 16 wherein the light metal of said master alloy is substantially pure aluminum.

18. The method of claim 13 wherein said electrolytic cell is divided into at least three areas by one or more porous membranes capable of withstanding prolonged contact with molten aluminum-lithium, a third cell area extending between the first and second cell areas and adapted to contact with a lithium ion-conducting electrolyte.

19. The method of claim 18 wherein the ion-conducting electrolyte for said third cell area consists essentially of: lithium chloride, lithium fluoride, calcium fluoride, potassium chloride and mixtures thereof.

20. The method of claim 19 which further includes:

(f) supplying the cell with a sufficient amount of ion-conducting electrolyte to cover at least the second cathode area and prevent master alloy exposure to gaseous reactants.

21. A method for making an aluminum-lithium master alloy using the lithium recovered from aluminum-lithium alloy scrap, said method comprising:

(a) providing an electrolytic cell divided into two or more laterally adjacent areas by one or more substantially porous membranes adapted for transporting lithium ions therethrough, a first cell area adapted to contact with molten aluminum-lithium and a second cell area adapted to contact with a cathode consisting essentially of molten aluminum;

(b) introducing aluminum-lithium alloy scrap to the first cell area and heating said scrap to one or more temperatures above about 625° C. (1157° F.);

(c) supplying substantially pure aluminum to the second cell area;

(d) supplying current to the cell at a sufficient rate for transporting lithium ions from the first cell area, through the porous membranes and to the second cell area; and (e) withdrawing aluminum-lithium master alloy from the second cell area.

22. The method of claim 21 wherein substantially only lithium ions are transported through said porous membranes during recitation (d).

23. The method of claim 21 wherein said porous membranes are saturated with a molten salt electrolyte containing one or more of: lithium chloride, lithium fluoride, calcium fluoride and potassium chloride.

24. A method for making a magnesium-lithium master alloy using the lithium recovered from molten aluminum-lithium alloy scrap, said method comprising:

(a) providing an electrolytic cell divided into two or more laterally adjacent areas by one or more substantially porous membranes adapted for transporting lithium ions therethrough, a first cell area adapted to contact with molten aluminum-lithium and a second cell area adapted to contact with a cathode consisting essentially of molten magnesium;

(b) introducing aluminum-lithium alloy scrap to the first cell area and heating said alloy scrap to one or more temperatures above about 625° C. (1157° F.);

(c) supplying substantially pure magnesium to the second cell area;

(d) supplying current to the cell at a sufficient rate for transporting lithium ions from the first cell area, through the porous membranes and to the second cell area; and (e) withdrawing magnesium-lithium master alloy from the second cell area.

25. An apparatus for making aluminum and/or magnesium master alloy using the alkali metal removed from alkali metal-containing scrap comprises:

(a) an electrolytic cell including a floor and a plurality of walls which define two or more substantially vertically-oriented areas of the cell, a first cell area adapted to contact with an anode consisting essentially of molten alkali metal-containing scrap and a second cell area adapted to contact with a cathode consisting essentially of molten aluminum and/or magnesium;

(b) means for transporting substantially only alkali metal ions from the first cell area to the second cell area;

(c) means for supplying current to the cell;

(d) means for removing master alloy from the second cell area;

(e) means for preventing exposure of the master alloy to reactants including air; and (f) means for distributing alkali metal substantially throughout the second cell area.

26. The apparatus of claim 25 wherein the ion transporting means includes at least one porous membrane in substantial contact with an alkali metal ion-conducting electrolyte.

27. The apparatus of claim 25 wherein the ion transporting means includes:

two or more substantially porous membranes which define a third cell area intermediate the first and second cell areas; and a sufficient amount of alkali metal ion-conducting electrolyte between said porous membranes.

28. The apparatus of claim 25 wherein the alkali metal in said scrap consists essentially of lithium.

29. The apparatus of claim 25 wherein the molten cathode consists essentially of substantially pure aluminum or substantially pure magnesium.

30. An apparatus for making aluminum and/or magnesium master alloy using the alkali metal removed from alkali metal-containing scrap comprises:

(a) an electrolytic cell including a floor and a plurality of walls defining two or more substantially vertically-oriented areas of the cell, a first cell area adapted to contact with an anode consisting essentially of molten alkali metal-containing scrap and a second cell area adapted to contact with a cathode consisting essentially of molten aluminum and/or magnesium;

(b) means for transporting alkali metal ions from the first cell area to the second cell area, said ion transporting means including:

two or more substantially porous membranes which define a third cell area intermediate the first and second cell areas; and a sufficient amount of alkali metal ion-conducting electrolyte between said porous membranes; and (c) means for supplying current to the cell.

31. The apparatus of claim 30 wherein the alkali metal consists essentially of lithium.

32. The apparatus of claim 30 wherein the cell cathode consists essentially of substantially pure aluminum or substantially pure magnesium.

33. An apparatus for substantially continuously making light metal-lithium master alloy from lithium-containing scrap metal, said apparatus comprising:

(a) an electrolytic cell including a floor and a plurality of walls defining at least two non-annular, substantially vertically-oriented cell areas, a first cell area adapted to contact with a molten scrap metal anode and a second cell area adapted to contact with a molten light metal cathode;

(b) porous means for transporting lithium ions from the first cell area to the second cell area; and (c) means for supplying current to the cell.

34. The apparatus of claim 33 which further includes one or more of:

(d) means for removing master alloy from the second cell area;

(e) means for preventing master alloy exposure to reactants; and (f) means for distributing lithium substantially throughout the second cell area.

35. The apparatus of claim 33 wherein the molten light metal cathode consists essentially of aluminum, magnesium or combinations thereof.

36. A method for making light metal-alkali metal master alloy from substantially pure light metal and alkali metal-containing scrap, said method comprising:

(a) establishing an electrolytic cell divided into two or more laterally adjacent areas by alkali metal ion-transporting means, a first cell area adapted to contact with molten alkali metal-containing scrap and a second cell area provided with substantially pure molten light metal;

(b) supplying current to the cell for transporting alkali metal ions from the first cell area to the second cell area;

(c) distributing alkali metal ions throughout the second cell area to form a master alloy; and (d) withdrawing master alloy from the second cell area.

37. The method of claim 36 wherein the alkali metal in said scrap consists essentially of lithium.

38. The method of claim 36 wherein the ion-transporting means consist essentially of porous magnesium oxide membranes.

39. The method of claim 36 wherein the ion-transporting means contact continuously with an alkali metal ion-conducting electrolyte which includes one or more of: lithium chloride, lithium fluoride, calcium fluoride and potassium chloride.

40. A method for continuously making aluminum-lithium master alloy from molten aluminum and the lithium recovered from aluminum-lithium scrap metal, said method comprising:

(a) providing an electrolytic cell divided into two or more laterally adjacent areas by porous magnesium oxide membranes through which lithium ions may be transported, a first cell area periodically supplied with aluminum-lithium scrap metal and a second cell area provided with a cathode of substantially pure molten aluminum;

(b) heating the scrap metal in the first cell area above about 625° C. (1157° F.) and below temperatures at which lithium vaporizes;

(c) supplying current to the cell for transporting lithium ions from the first cell area, through the porous membranes and to the second cell area; and (d) withdrawing aluminum-lithium master alloy from the second cell area.

41. The method of claim 40 wherein the porous membranes contact continuously with a molten salt electrolyte which includes one or more of: lithium chloride, lithium fluoride, calcium fluoride and potassium chloride.

42. A method for continuously making magnesium-lithium master alloy from magnesium and the lithium recovered from aluminum-lithium scrap metal, said method comprising:

(a) providing an electrolytic cell divided into two or more laterally adjacent areas by porous membranes through which lithium ions may be transported, a first cell area periodically supplied with aluminum-lithium scrap metal and a second cell area provided with a molten magnesium cathode;

(b) heating the scrap metal in the first cell area above about 625° C. (1157° F.) and below temperatures at which lithium vaporizes;

(c) supplying current to the cell for transporting lithium ions from the first cell area, through the porous membranes and to the second cell area; and (d) withdrawing magnesium-lithium master alloy from the second cell area.

43. The method of claim 42 wherein the porous membranes contact continuously with a molten salt electrolyte which includes one or more of: lithium chloride, lithium fluoride, calcium fluoride and potassium chloride.

* * * * *